US012460366B2

(12) United States Patent
Gale

(10) Patent No.: US 12,460,366 B2
(45) **Date of Patent: *Nov. 4, 2025**

(54) RETICULATED DRIVEN MICROPILE FOOTING SYSTEM

(71) Applicant: Gary Gale, Fingal (AU)

(72) Inventor: Gary Gale, Fingal (AU)

( * ) Notice: Subject to any disclaimer, the term of this patent is extended or adjusted under 35 U.S.C. 154(b) by 0 days.

This patent is subject to a terminal disclaimer.

(21) Appl. No.: 18/608,257

(22) Filed: Mar. 18, 2024

(65) Prior Publication Data

US 2024/0240421 A1 Jul. 18, 2024

Related U.S. Application Data

(63) Continuation of application No. 17/734,803, filed on May 2, 2022, now Pat. No. 11,933,014.

(51) Int. Cl.
*E02D 5/54* (2006.01)

(52) U.S. Cl.
CPC ..... *E02D 5/54* (2013.01)

(58) Field of Classification Search
CPC ..... E02D 5/54
See application file for complete search history.

(56) References Cited

U.S. PATENT DOCUMENTS

| | | | | |
|---|---|---|---|---|
| 2,826,281 | A | 3/1958 | Green | |
| 2,870,884 | A | 1/1959 | Mazur | |
| 3,903,662 | A | 9/1975 | Gabliya et al. | |
| 5,515,656 | A | 5/1996 | Mihalich | |
| 5,873,679 | A | 2/1999 | Cusimano | |
| 6,146,056 | A * | 11/2000 | Calandra, Jr. | E21D 21/0086 411/545 |
| 6,622,439 | B2 | 9/2003 | Moreno, Jr. | |
| 6,871,455 | B1 | 3/2005 | Cockman et al. | |
| 6,910,832 | B2 | 6/2005 | Gagliano et al. | |
| D666,473 | S | 9/2012 | Despotellis | |
| D666,474 | S | 9/2012 | Despotellis | |
| D666,895 | S | 9/2012 | Despotellis | |
| 8,561,361 | B2 | 10/2013 | Bauletti | |
| 8,601,750 | B1 | 12/2013 | Zhu | |
| 8,714,881 | B2 | 5/2014 | Gagliano | |
| 9,518,368 | B2 | 12/2016 | Nishioka et al. | |
| 2014/0174003 | A1 * | 6/2014 | Despotellis | E02D 5/80 52/169.13 |
| 2021/0381188 | A1 * | 12/2021 | Wójcikowski | E01F 9/685 |
| 2022/0010516 | A1 * | 1/2022 | Miller | E02D 5/526 |

FOREIGN PATENT DOCUMENTS

WO WO2013000022 A1 1/2013

* cited by examiner

*Primary Examiner* — Kyle Armstrong
(74) *Attorney, Agent, or Firm* — KEATY LAW FIRM LLC; Thomas S. Keaty

(57) ABSTRACT

A reticulated driven micropile footing system for installation of concrete-free removable reusable footings without heavy machinery, providing a one-piece pile cap having embossing for strengthening, mount holes for mounting of structural pieces such as posts or beams, a medial opening to facilitate placement and stabilization prior to installation, angled guides to facilitate driving of micropiles at a proper angle, pile openings through which to drive micropiles, upper set holes for secure fastening of the one-piece pile cap to the driven micropiles, and optionally lower set-adjust holes for the further secure fastening of the one-piece pile cap to the driven micropiles and for adjusting the angle of individual micropiles when needed.

7 Claims, 11 Drawing Sheets

RETICULATED DRIVEN MICROPILE FOOTING SYSTEM

CROSS-REFERENCE TO RELATED APPLICATION

This application is a continuation of co-pending application Ser. No. 17/734,803, filed on May 2, 2022, the full disclosure of which is incorporated by reference herein and priority of which is hereby claimed.

BACKGROUND OF THE INVENTION

This invention provides a reticulated driven micropile footing system and method for installation of concrete-free removable reusable footings without heavy machinery.

Traditional methods for footings have some significant disadvantages in costs of materials, labor, and environmental impact due to the need for heavy equipment for transport and for installation, the need to use such heavy equipment at sometimes remote or difficult job sites, and the need for favorable weather conditions.

Concrete pads and piers require a large amount of site preparation, digging, forming, reinforcing, pouring, and curing. The site must be accessible to heavy concrete trucks and the concrete must often be pumped from the truck. A large amount of water is needed. Installation takes several days, and then even more time is required before a load can be applied. The mixing of concrete is bad for the environment. Concrete footings are hard to remove after the end of their use. And concrete pads and piers are only capable of bearing low loads in good soils, and are often ineffective in poor soils and sands. If timber piles are set or grouted in concrete, then the disadvantages of concrete also apply. If timber piles are driven, then a heavy pile driver must be accommodated on site, and the pile driving might damage adjacent structures. Helical piles can only support low loads. Screw piles are expensive and require specialist machinery and operators.

When footings are installed for support or remediation of historic buildings, or installed at archeologically significant sites, there is a great danger, and sometimes a certainty, that traditional methods for footings will cause damage to the building or site.

When footings are needed for the quick installation of modular buildings or emergency equipment, which are later to be taken down or moved away, the traditional methods for footings cannot be installed quickly and cannot later be removed effectively.

What is needed is a system and method for installation of footings having a very high bearing capacity even in poor soils, which does not require the use of heavy equipment or transport of heavy materials, which does not require extensive site preparation, which can be installed quickly and bear loading almost immediately, which can be removed completely, which does not unnecessarily damage the installation site, and which does not use environmentally costly materials and methods.

SUMMARY OF THE INVENTION

This invention provides a reticulated driven micropile footing system for installation of concrete-free removable reusable footings without heavy machinery.

The reticulated driven micropile footing system provides a one-piece pile cap having embossing for strengthening, mount holes for mounting of structural pieces such as posts or beams, a medial opening to facilitate placement and stabilization prior to installation, angled guides to facilitate driving of micropiles at a proper angle, pile openings through which to drive micropiles, upper set holes for secure fastening of the one-piece pile cap to the driven micropiles, and optionally lower set-adjust holes for the further secure fastening of the one-piece pile cap to the driven micropiles and for adjusting the angle of individual micropiles when needed.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
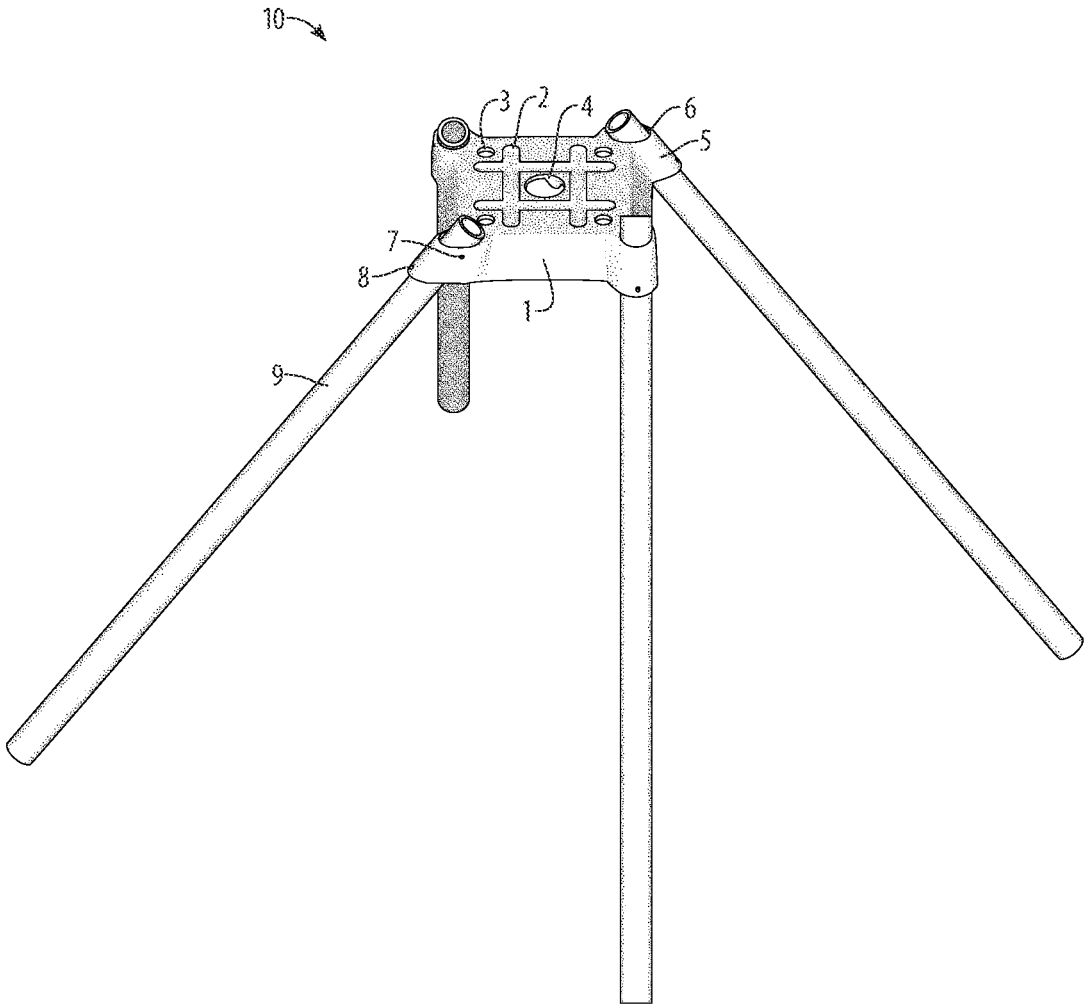
FIG. 1 is a perspective view of the reticulated driven micropile footing system of the invention.
Figure 2:
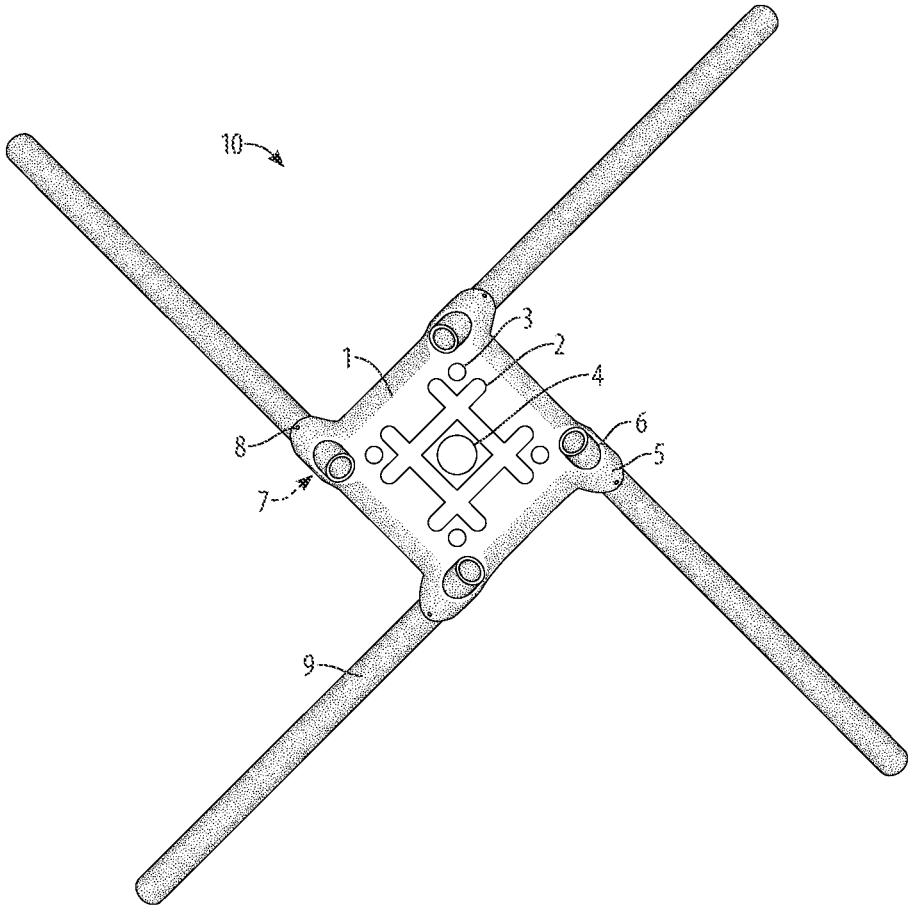
FIG. 2 is a top view of the reticulated driven micropile footing system of the invention.
Figure 3:
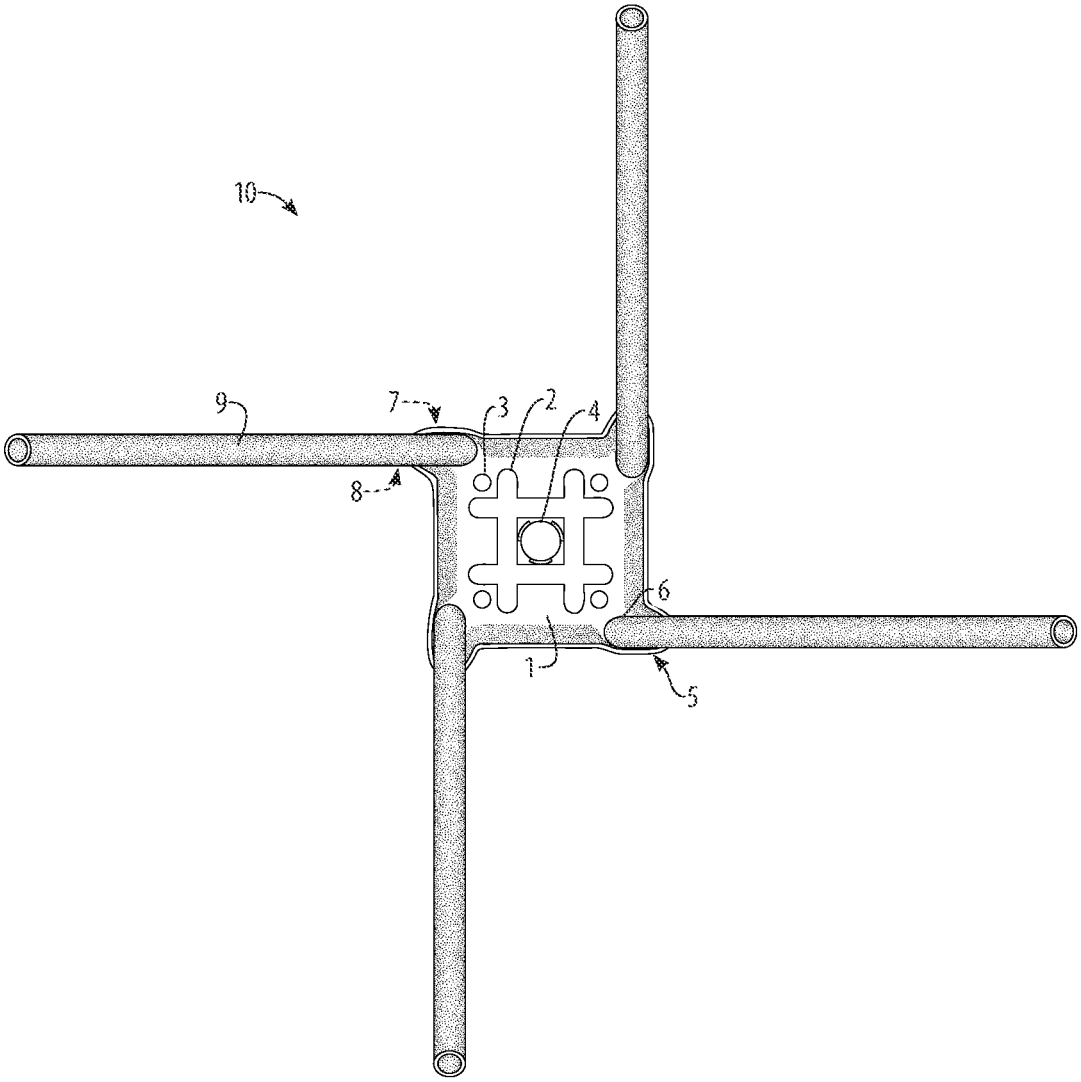
FIG. 3 is a bottom view of the reticulated driven micropile footing system of the invention.

Referring to FIGS. 1-3, the reticulated driven micropile footing system 10 provides a one-piece pile cap 1 having embossing 2 for strengthening, mount holes 3 for the mounting of structural pieces such as posts or beams, a medial opening 4 to facilitate placement and stabilization prior to installation, angled guides 5 to facilitate driving of micropiles 9 at a proper angle, pile openings 6 through which to drive micropiles 9, upper set holes 7 for secure fastening of the one-piece pile cap 1 to the driven micropiles 9, and optionally lower set-adjust holes 8 for the further secure fastening of the one-piece pile cap 1 to the driven micropiles 9 and for adjusting the angle of individual micropiles 9 when needed.

The one-piece pile cap 1 provides the structure which holds the micropiles together in a reticulated group or network, as treated below. The one-piece pile cap 1 is formed of one piece, without any components being welded or otherwise fixed onto it, making the one-piece pile cap 1 less complicated and less expensive to manufacture, and avoiding possible structural failures at welds or other points of attachment in use. Steel is an appropriate material for the one-piece pile cap 1. Rust prevention can be accomplished by galvanization, which is the usual method, or by other treatments, painting, enameling, or powder coating. The use of galvanized steel in various soils and foundation environments is well understood after extensive experience and study. The main illustrated embodiment of the reticulated driven micropile footing system 10, which would be appropriate for at least 100 kN loading in good soil, has a one-piece pile cap 1 made of galvanized steel, is approximately 250 mm by 250 mm square and 6 mm thick, and is used with four micropiles 9 each having 42.4 mm diameter. Other embodiments appropriate for lesser or greater loading have smaller or larger one-piece pile caps 1 and different numbers of micropiles 9. An embodiment of the one-piece pile cap 1 can be made by bending, stamping, and drilling, die-cutting, or laser-cutting a sheet of steel.

The one-piece pile cap 1 has a top surface which is substantially flat aside from holes and embossing, and has sides descending downward, which forms an open shell structure which is inherently strong and resistant to deformation. The one-piece pile cap 1 is further strengthened against deformation with embossing 2 as shown. During manufacture, the embossing 2 can be accomplished by stamping.

Figure 4:
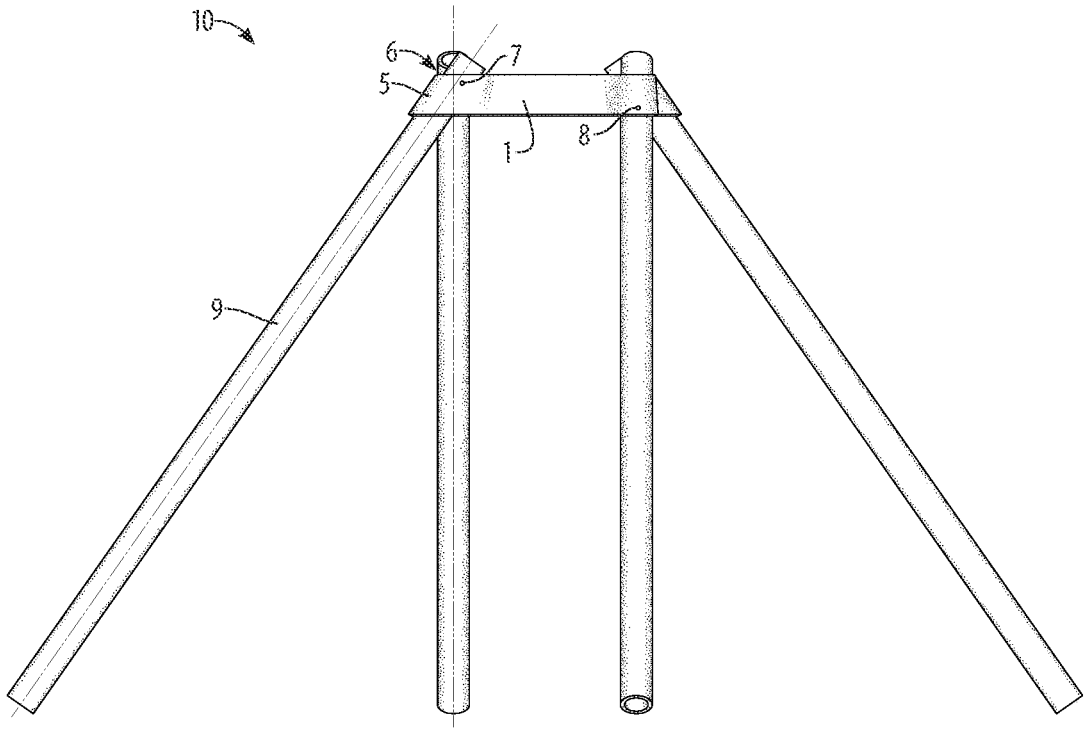
FIG. 4 is a side view of the reticulated driven micropile footing system of the invention.

Referring to FIG. 4, the angled guides 5 of the one-piece pile cap 1 guide the micropiles 9, which are driven through the pile openings 6, into the ground at a set angle, and after installation the angled guides 5 provide a substantial area of contact for the one-piece pile cap 1 to bear upon the micropiles 9. The illustrated embodiment shows an angle of 35 degrees from vertical, which is generally appropriate for many soils, sands, and circumstances. Embodiments having angles of 30 degrees or 25 degrees are often also appropriate, and embodiments providing these angles are also contemplated for the reticulated driven micropile footing system 10. As treated below, optionally the angle of the micropile 9 can be adjusted using a lower set-adjust hole 8.

The bearing capacity of an individual micropile 9 is primarily due to the bearing resistance of soil underneath the driven micropile and to skin friction. Because of the small toe area of the micropile the end bearing capacity is also small unless the micropile rests on hard rock. Micropiles 9 might twist during installation or in use under load. Such twisting does not degrade, and might enhance bearing capacity. It is possible that bearing capacity is enhanced by a soil arching effect. When micropiles 9 are joined in a reticulated network, as provided in the reticulated driven micropile footing system 10, bearing-capacity enhancing group effects and reinforcing effects, sometimes called "tree root" effects, are seen. Such group effects might be due in part to confinement of soil within the reticulated network of micropiles 9.

Figure 5:
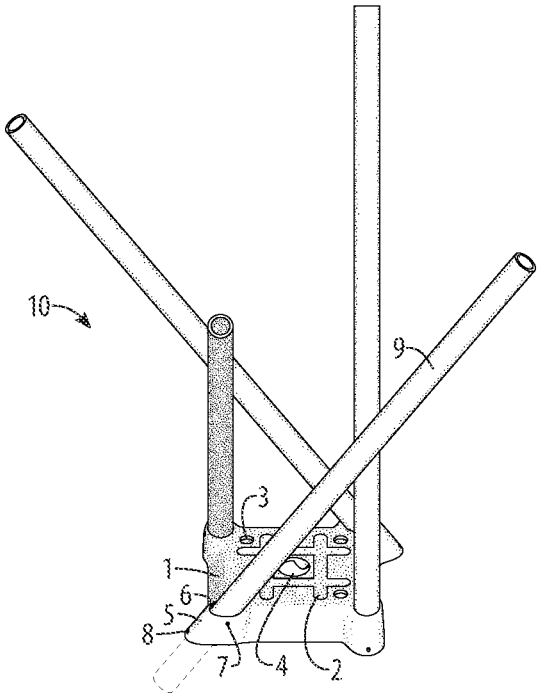
FIG. 5 is a perspective view of the reticulated driven micropile footing system of the invention in use during the driving of a micropile.

Referring to FIG. 5, in use, the one-piece pile cap 1 is placed on or near the ground, the micropiles 9 are placed through the pile openings 6, following the angled guides 5, and are driven into the ground. The micropiles can be driven with a hammer or a jackhammer, or with some combination, such as being started with a manual hammer or with a light-duty jackhammer and then finished with a heavy-duty jackhammer. No grading, digging, drilling, or other substantial site preparation is required for installing the reticulated driven micropile footing system 10, apart from measuring and marking the site. Digging or drilling of holes for the micropiles 9 should not be done. Cement grouting of the micropiles 9 should not be done. The length of the micropiles 9 needed for a particular installation is determined by analysis of the soil conditions and the load-bearing requirements for the installation. Finished lengths of micropiles 9 can be cut in advance of installation, or can be cut on site. The one-piece pile caps 1 and micropiles 9 for an installation can be transported and stored easily.

The micropiles 9 can be lengths of pipe. Galvanized steel pipe is appropriate because the use of galvanized steel in soils and for foundations and structural members is well understood, the skin-friction properties are known, and galvanized steel pipe is widely available at relatively low cost. Steel rod could be used instead of pipe, but would be more expensive and would not provide significant performance advantages. Other metals, plastics, and other materials, such as carbon fiber, can be used, but would likely be more expensive and more difficult to source. In a preferred embodiment, 32 Nominal Bore galvanized pipe 42.4 mm diameter is used as micropiles 9.

The load-bearing performance of the micropiles 9 can be adjusted for various soil conditions and loading requirements by adjusting the length used, without changing diameter, which would require different sized piling openings 6 in different one-piece pile caps 1. The length to be used for a particular installation is determined after analysis of soil conditions and load-bearing requirements. A typical installation in good soil might require micropiles of approximately 2 meters or 3 meters length. Longer micropiles might typically be required for poor soils or sand. Lengths of 6 meters or longer can be used, but are subject to the practical limitations of starting the micropile driving very high off the ground, overcoming increasing skin friction during driving, and obtaining and transporting such long galvanized steel pipes. An alternative to using very long micropiles 9 is to use an embodiment of the reticulated driven micropile footing system 10 which provides a greater number of micropiles 9.

Figure 6:
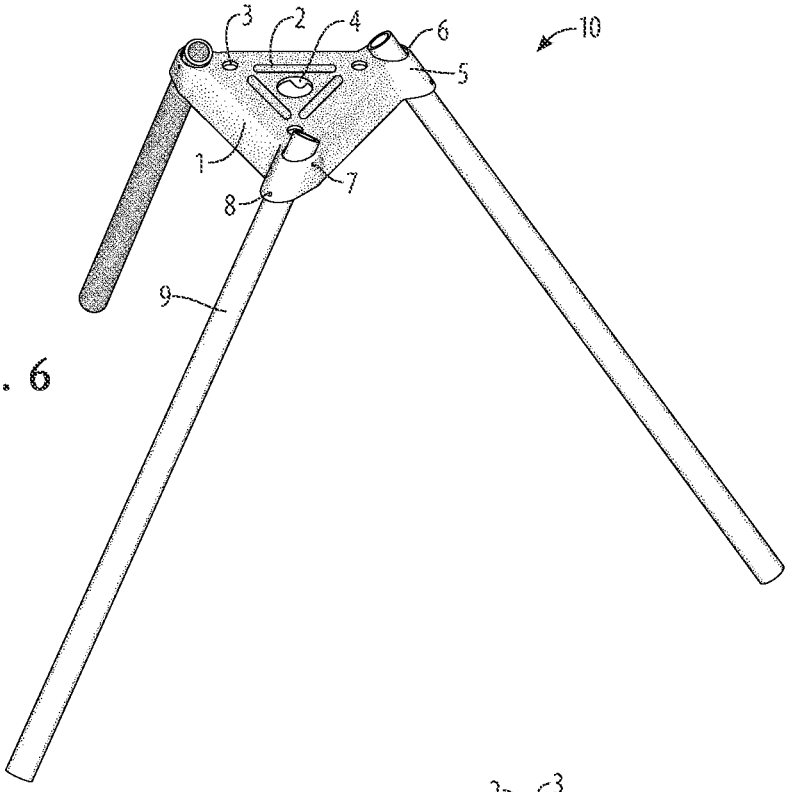
FIG. 6 is a perspective view of an embodiment of the reticulated driven micropile footing system of the invention having three micropiles.
Figure 7:
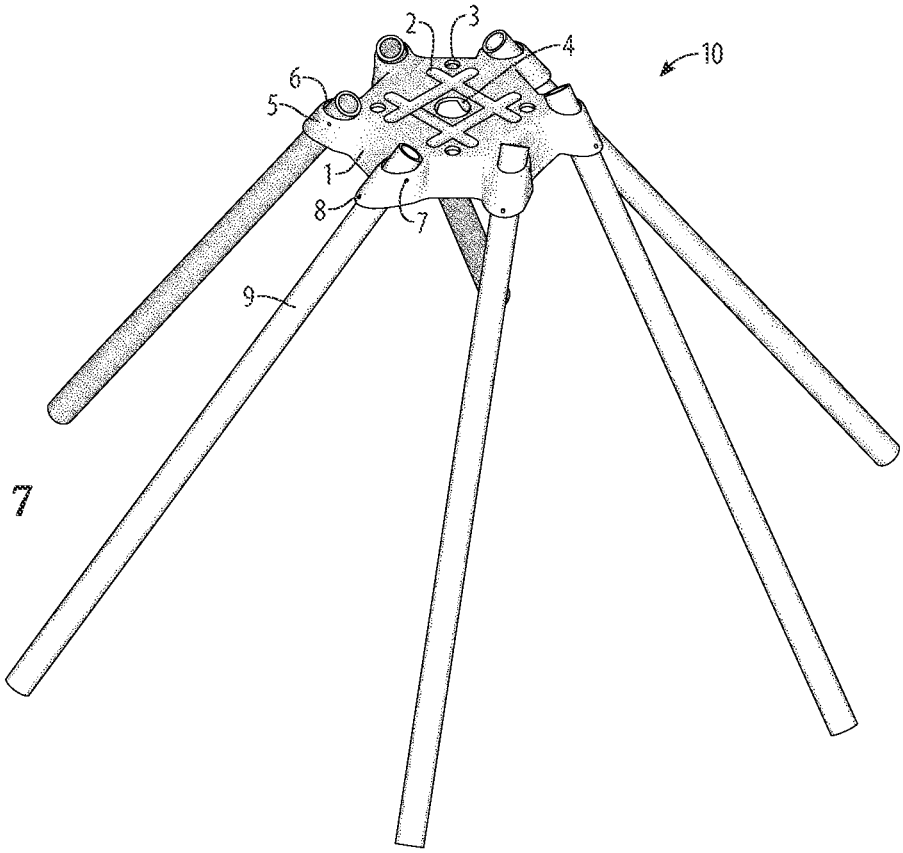
FIG. 7 is a perspective view of an embodiment of the reticulated driven micropile footing system of the invention having six micropiles.

Referring to FIG. 6, embodiments of the reticulated driven micropile footing system 10 can provide a varied number of micropiles 9 appropriate to the soil conditions and anticipated load conditions. At least three micropiles 9, as shown, should be provided for stability. Referring to FIG. 7, showing an embodiment providing six micropiles 9, the load-bearing capabilities of the reticulated driven micropile footing system 10 can be increased with the provision of embodiments having additional micropiles 9.

Figure 8:
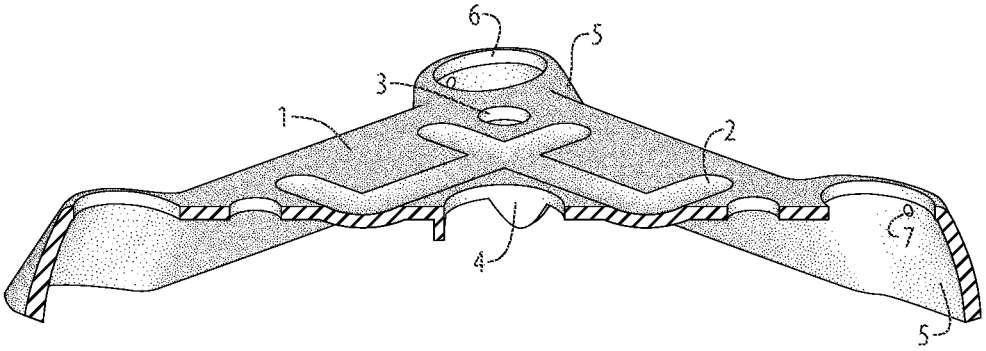
FIG. 8 is a section view of the one-piece pile cap of the reticulated driven micropile footing system of the invention.
Figure 9:
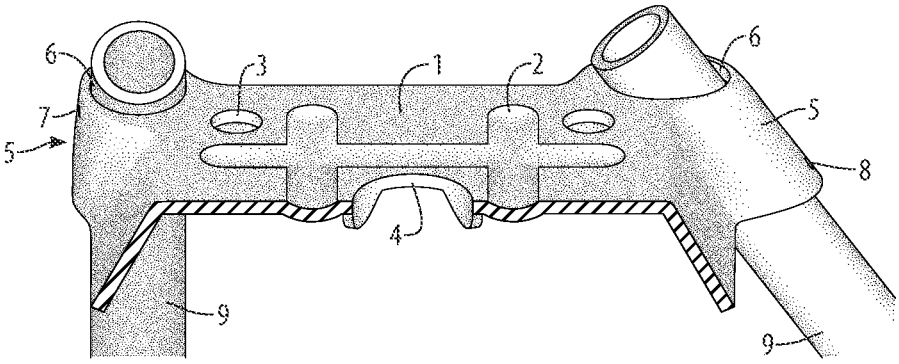
FIG. 9 is a section view of the reticulated driven micropile footing system of the invention.

Referring to FIGS. 8 and 9, the medial opening 4 of the one-piece pile cap 1 can provide descending tabs which provide additional strength to the area of the medial opening 4, provide additional surface area or contact area for objects such as pipes passing through the medial opening 4, as treated below, or provide a means of centering the one-piece pile cap 1 on a pipe. During manufacture, material for the tabs can be left in place when cutting the medial opening 4, and the tabs can be bent downward by stamping, which can be done in coordination with the stamping to form the embossing 2.

Figure 10:
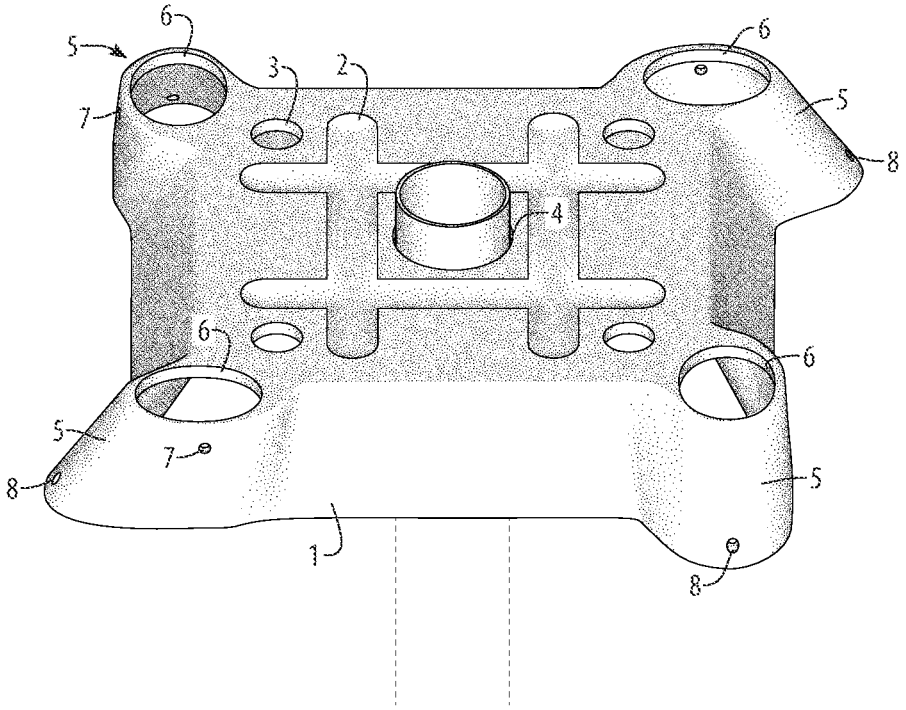
FIG. 10 is a perspective view of the one-piece pile cap of the reticulated driven micropile footing system of the invention placed upon a post.
Figure 11:
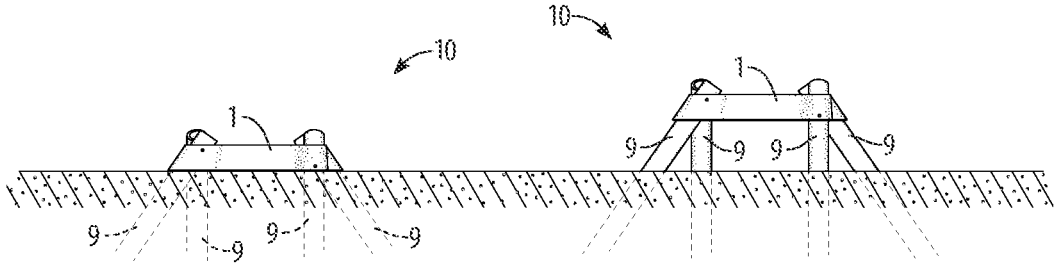
FIG. 11 is a side view of the reticulated driven micropile footing system of the invention in use installed at and above ground level.

Referring to FIG. 10, in use, a pipe or similar tube or post or stake can be placed at the spot where the footing is intended to be installed, and the medial opening 4 of the one-piece pile cap 1 can be placed over it to fix the one-piece pile cap 1 in place for driving of the micropiles. Alternatively, the pipe or post can be used as a central vertical piling, in which case the top of the post should be set to the proper elevation and the one-piece pile cap 1 should be placed on top of the post. Referring additionally to FIG. 11, the reticulated driven micropile footing system 10 can be installed with the one-piece pile cap 1 placed upon the ground, or with the one-piece pile cap 1 elevated above the ground. For an elevated installation, a central vertical piling can be used, or the one-piece pile cap 1 can initially be placed on a block or be clamped to a pipe or stake placed through the medial opening 4. If installation substantially above the ground is needed, longer micropiles 9 might be used to ensure enough length underground. Alternatively, because a variety of structural pieces can be securely, adjustably, and removably attached via the mount holes 3, variations in ground level can be compensated for by using various sizes or adjustable intermediate posts.

Figure 12:
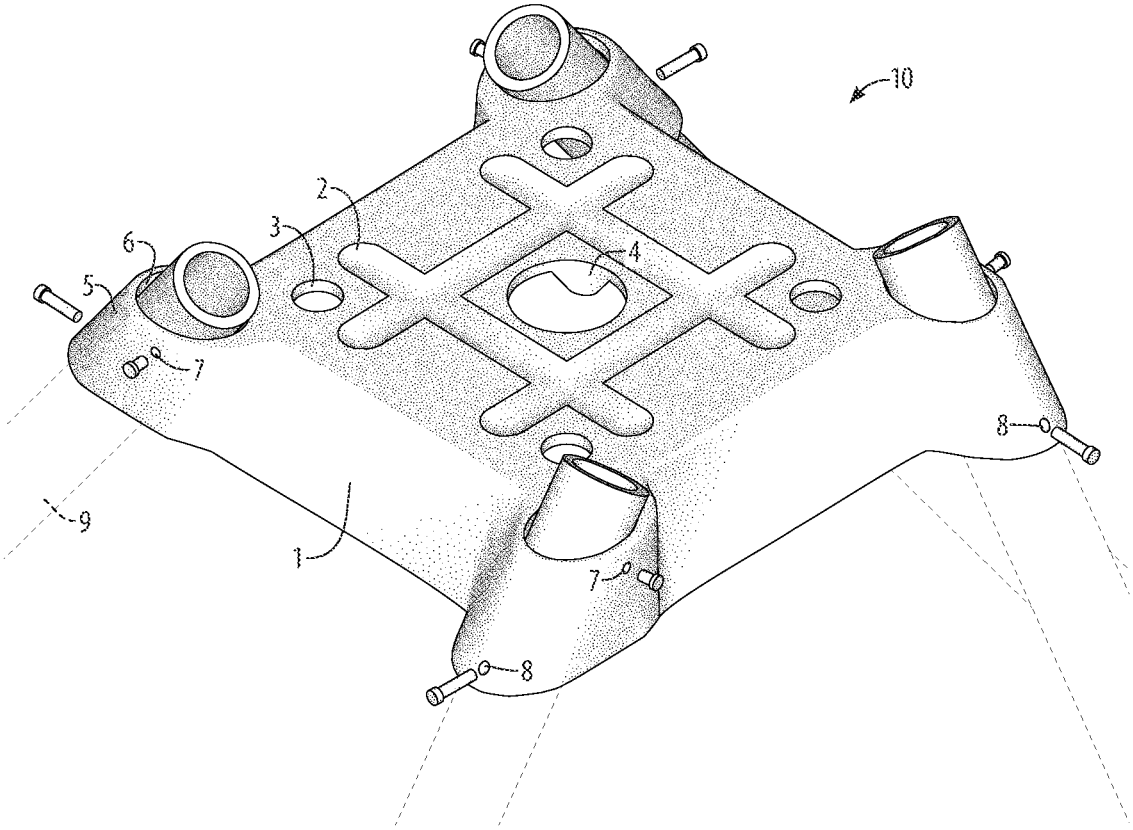
FIG. 12 is a perspective view of the reticulated driven micropile footing system of the invention in use prior to placement of set screws.
Figure 13:
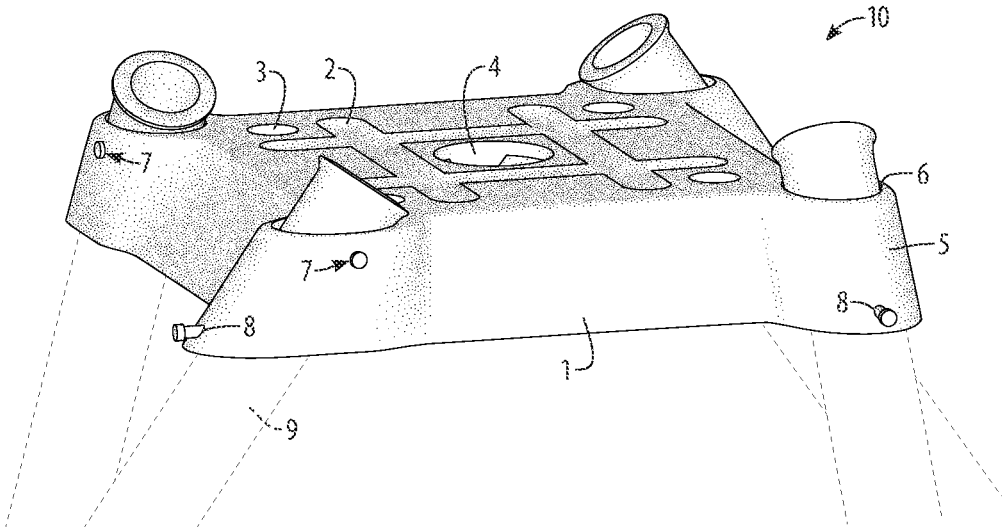
FIG. 13 is a perspective view of the reticulated driven micropile footing system of the invention in use after placement of set screws.

Referring to FIG. 12, upper set holes 7 are provided for securely fixing the tops of the driven micropiles to the one-piece pile cap 1, to prevent the one-piece pile cap 1 from being pulled off of the micropiles 9. The upper set holes 7 can be threaded for use with threaded fasteners or can be left plain for use with self-tapping screws or with another method such as drilling and riveting. Optionally, the lower set-adjust holes 8 can also be used for fixing the driven micropiles to the one-piece pile cap 1. Referring additionally to FIG. 13, the process of driving the micropiles 9 will likely cause some deformation such as splaying or mushrooming of the tops of the micropiles 9, which provides an additional mechanism for preventing any pull-off of the one-piece pile cap 1. The splaying or mushrooming can be done intentionally using wedges or similar tools. Any damage to the galvanized surface of the micropiles 9 or to the one-piece pile cap 1 can be remediated by on-site application of galvanized or rust-inhibiting paint.

Installation of the reticulated driven micropile footing system 10 requires very little site preparation, requires no digging, requires no heavy machinery, and requires no concrete work such as forming, the logistics and costs of delivery of concrete to the site and transfer of concrete from the trucks, finishing, curing, form removal, and inspection. Installation of one unit of the reticulated driven micropile footing system 10 can be accomplished by one person with a jackhammer in substantially under an hour. Installation can be accomplished in rain and weather which would prevent use of heavy machinery or pouring of concrete.

In most circumstances the reticulated driven micropile footing system 10 can be removed, leaving no materials and very little disturbance to the site. Micropiles can be left in the ground as stabilization, or can be pulled out, one at a time, using a small excavator or similar machine, or a sufficiently powerful jack.

The reticulated driven micropile footing system 10 facilitates the rapid setting up and taking down of modular buildings, generators, communications systems, and the like such as might be required for response to a disaster or other situations. The components of the reticulated driven micropile footing system 10 can be acquired, staged in advance, and transported with the modular buildings and machines.

Figure 14:
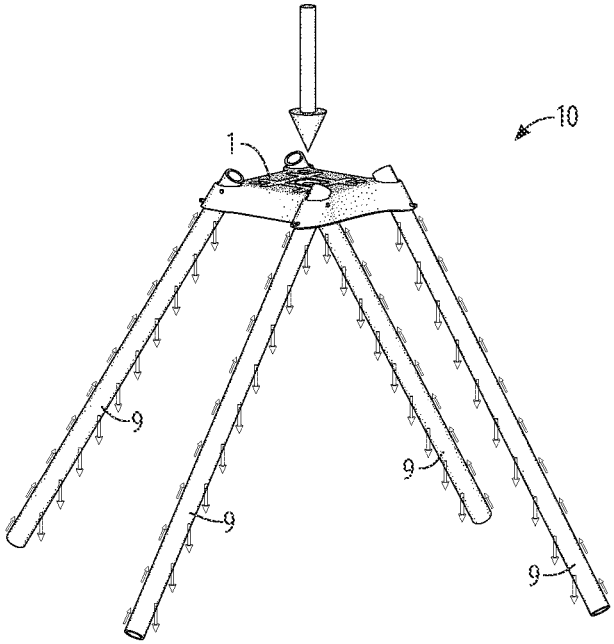
FIG. 14 is a schematic view of forces acting upon the micropiles of the reticulated driven micropile footing system of the invention in use during application of only downward force.
Figure 15:
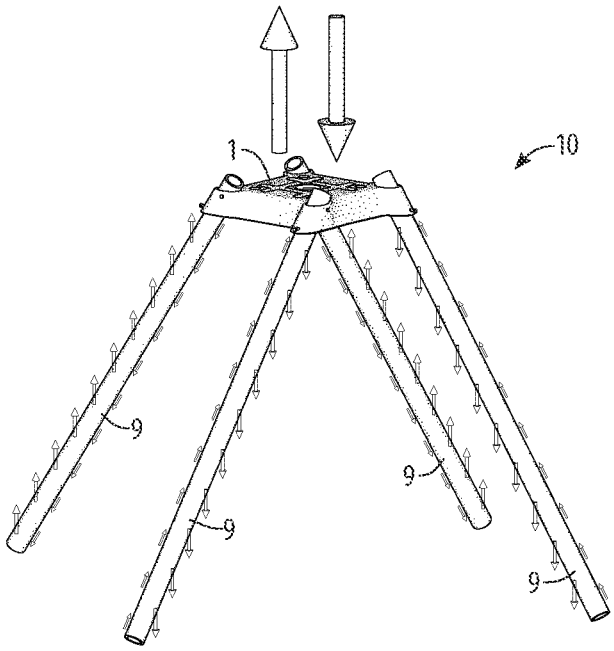
FIG. 15 is a schematic view of forces acting upon the micropiles of the reticulated driven micropile footing system of the invention in use during application of both downward and upward forces.

Referring to FIG. 14, in use, under an axial downward imposed load, the resistance of the reticulated driven micropile footing system 10 against the imposed load comes primarily from a combination of bearing resistance of soil underneath the driven micropiles 9 and skin friction of the individual micropiles 9. Group effects, reinforcing and twisting effects, and soil arching, as treated above, are believed to contribute to the total bearing resistance. Referring to FIG. 15, in use, under an applied bending moment having compression and tension components, resistance to the tension loading comes primarily from a combination of the passive resistance of soil under pull-out forces and skin friction of the individual micropiles.

Figure 16:
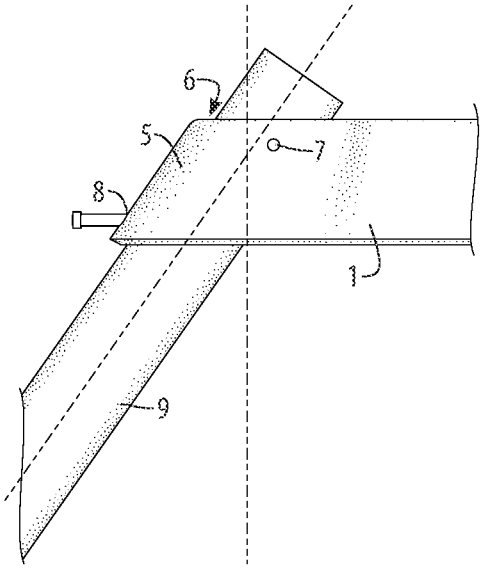
FIG. 16 is a side detail view of the reticulated driven micropile footing system of the invention with a micropile set at the angle defined by the angled guide.
Figure 17:
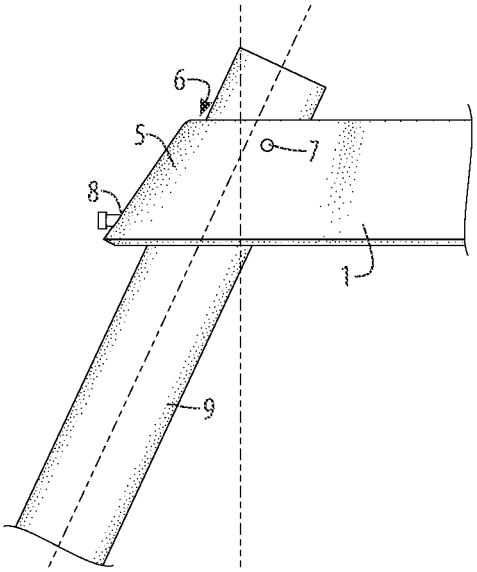
FIG. 17 is a side detail view of the reticulated driven micropile footing system of the invention with a micropile set at an angle changed by the influence of the lower set-adjust hole.

Referring to FIGS. 16 and 17, the angled guide 5 portion of the one-piece pile cap 1 sets an angle for the driving of micropiles. As treated above, an angle from vertical of 25-to-35 degrees, inclusive, is appropriate. An embodiment having angled guides 5 having an angle of 35 degrees is illustrated in FIG. 16. After a micropile 9 is driven at the 35-degree angle set by the angled guide 5, a set screw or other fastener placed through the upper set hole 7 is used to fix the micropile 9 to the one-piece pile cap 1, as treated above. Optionally, a lower set-adjust hole 8 can be provided, and can be used with a fastener to provide additional fixing of the micropile 9 to the one-piece pile cap 1. In FIG. 17 the same embodiment of the one-piece pile cap 1 having a 35-degree angle guide 5 is shown where the micropile 9 has been driven at a 25-degree angle instead of 35 degrees. The optional lower set-adjust hole 8 can be used to decrease the guided angle of driving by installing a protruding piece, such as a threaded screw or bolt, through the lower set-adjust hole 8 such that it protrudes into the angled guide 5 and guides the inserted micropile into a lesser angle. Driving the micropiles 9 at such a lesser angle might be appropriate or necessary under certain conditions. Driving a particular micropile 9 at a lesser angle might be appropriate or necessary where that micropile 9 might be blocked by an underground obstruction or by services, or where full horizontal extension might cause an underground encroachment across a boundary.

Figure 18:
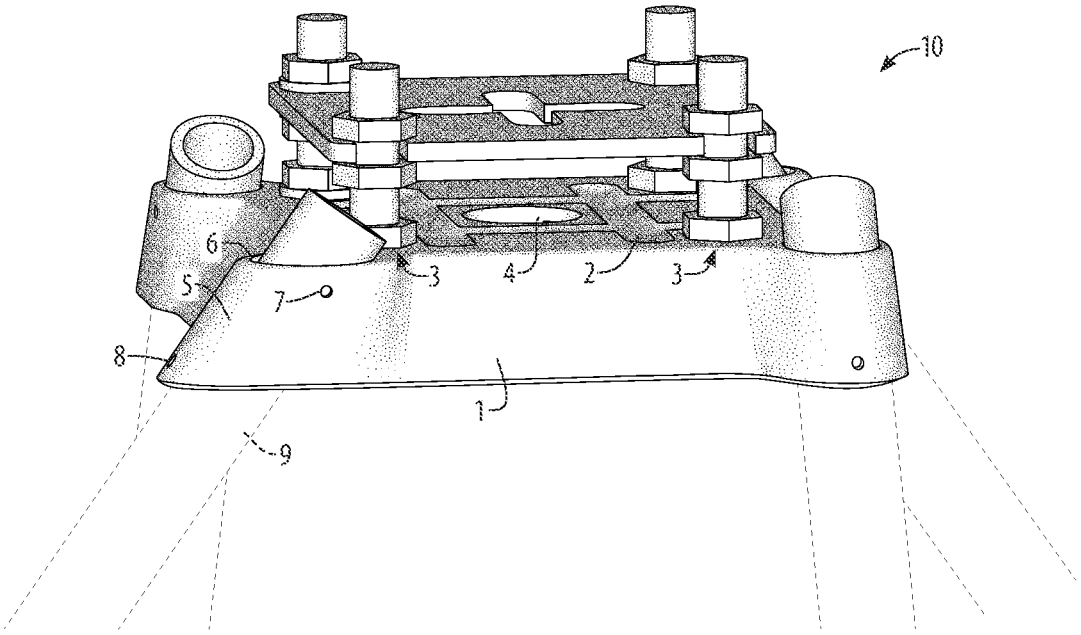
FIG. 18 is a perspective view of the reticulated driven micropile footing system of the invention in use with external structural components mounted.
Figure 19:
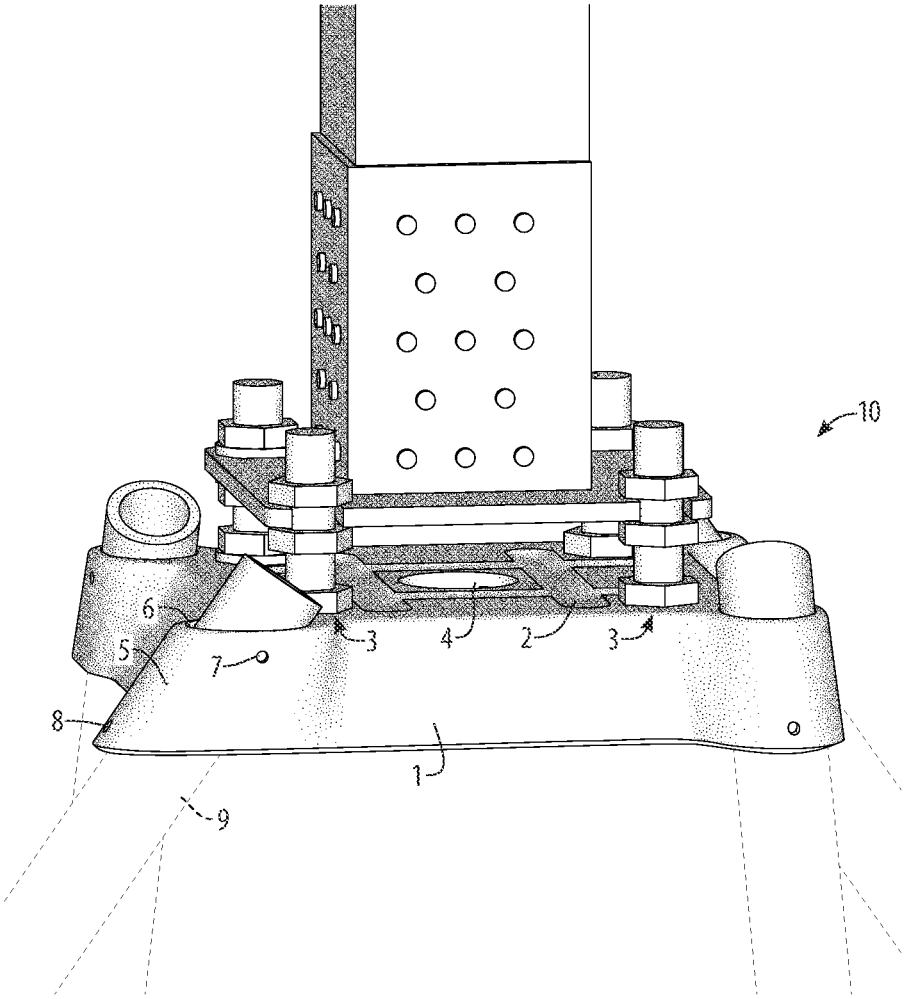
FIG. 19 is a perspective view of the reticulated driven micropile footing system of the invention in use with an external post mounted.

Referring to FIGS. 18 and 19, the mount holes 3 are used to securely, adjustably, and removably attach structural pieces to the one-piece pile cap 1 of the reticulated driven micropile footing system 10. FIG. 18 shows attachment of an adjustable baseplate or base bracket, and FIG. 19 shows adjustable attachment of a base for a post. Bolts and nuts can be used for attachment and for adjustment, as shown. At least three mount holes 3 are needed in order to allow attachment which is resistant to bending moment in all directions. Four mount holes 3, as illustrated, are appropriate. Mount holes 3 in excess of four are possible, but would need to provide sufficient enhancement to justify weakening of the one-piece pile cap 1 with additional holes. The medial opening 4 can also sometimes be used for attachment of structural pieces.

Many other changes and modifications can be made in the system and method of the present invention without departing from the spirit thereof. I therefore pray that my rights to the present invention be limited only by the scope of the appended claims.

I claim:

1. A reticulated driven micropile footing method comprising:

(i) providing a reticulated driven micropile footing system comprising:

(a) a one-piece pile cap having a flat top surface and a continuous peripheral sidewall descending downward to form an open shell;

(b) embossing formed into said flat top surface, adapted to strengthen said one-piece pile cap against distortion;

(c) at least one mount hole extending through said one-piece pile cap, adapted to provide for mounting to said one-piece pile cap;

(d) a medial opening in said one-piece pile cap, wherein said embossing being formed adjacent said medial opening;

(e) at least three micropiles;

(f) at least three angled guides formed in the sidewall of said one-piece pile cap and extending outwardly therefrom, said guides being adapted to guide said micropiles at a defined angle relative to the top surface of said one-piece pile cap;

(g) at least three pile openings through the top surface of said one-piece pile cap, each through a said angled guide, adapted to allow angled insertion of a said micropile; and (h) upper set holes in said one-piece pile cap near said pile openings, adapted to facilitate secure fastening of said one-piece pile cap to said micropiles;

(ii) analyzing soil conditions and load-bearing requirements for footings;

(iii) determining number and length of said micropiles for each said one-piece pile cap sufficient to meet said load-bearing requirements under said soil conditions;

(iv) placing said one-piece pile cap;

(v) placing said micropiles through said pile openings and said angle guides;

(vi) driving said micropiles through said pile openings at the angle set by said angle guides;

(vii) fastening said micropiles to said one-piece pile cap through said upper set holes; and (viii) attaching structural pieces to said one-piece pile cap through said mount holes.

2. The reticulated driven micropile footing method of claim 1, further comprising further fastening said micropiles to said one-piece pile cap through lower set-adjust holes.

3. The reticulated driven micropile footing method of claim 1, further comprising changing the angle at which said micropiles are driven by placing a protruding piece through lower set-adjust holes.

4. The reticulated driven micropile footing method of claim 1, where said placing said one-piece pile cap further comprises placing a post at the spot where the footing is intended to be installed, and placing said medial opening of said one-piece pile cap over said post to fix said one-piece pile cap in place for driving of said micropiles.

5. The reticulated driven micropile footing method of claim 1, where said placing said one-piece pile cap further comprises placing a central vertical pile at the spot where the footing is intended to be installed, and placing said medial opening of said one-piece pile cap upon said central vertical pile to fix said one-piece pile cap in place for driving of said micropiles.

6. The reticulated driven micropile footing method of claim 1, further comprising removing said reticulated driven micropile footing system by unfastening said one-piece pile cap from said micropiles and pulling said micropiles out of the soil.

7. A reticulated driven micropile footing method comprising:

(i) providing a reticulated driven micropile footing system comprising:

(a) a one-piece pile cap of galvanized steel having a flat top surface and continuous peripheral sidewall descending downward to form an open shell;

(b) embossing formed in the flat top surface of said one-piece pile cap, adapted to strengthen said one-piece pile cap against distortion;

(c) at least three mount holes through said one-piece pile cap, adapted to provide for mounting to said one-piece pile cap;

(d) a medial opening in said one-piece pile cap, having tabs, wherein said embossing being formed adjacent said medial opening;

(e) at least three micropiles of galvanized steel;

(f) at least three angled guides formed in the sidewall of said one-piece pile cap and extending outwardly therefrom, said guides being adapted to guide said micropiles at a defined angle relative to the top surface of said one-piece pile cap;

(g) at least three pile openings through the top surface of said one-piece pile cap, each through a said angled guide, adapted to allow the angled insertion of a said micropile;

(h) upper set holes in said one-piece pile cap near said pile openings, adapted to facilitate secure fastening of said one-piece pile cap to said micropiles; and (i) lower set-adjust holes in said one-piece pile cap at said angled guides, adapted to facilitate a change in the angle at which said micropiles are driven;

(ii) analyzing soil conditions and load-bearing requirements for footings;

(iii) determining the number and the length of said micropiles for each said one-piece pile cap sufficient to meet said load-bearing requirements under said soil conditions;

(iv) placing said one-piece pile cap;

(v) placing said micropiles through said pile openings and said angle guides;

(vi) driving said micropiles through said pile openings at the angle set by said angle guides;

(vii) fastening said micropiles to said one-piece pile cap through said upper set holes; and (viii) attaching structural pieces to said one-piece pile cap through said mount holes.

* * * * *